US005607330A

United States Patent [19]

Hanz

[11] Patent Number: 5,607,330

[45] Date of Patent: Mar. 4, 1997

[54] COLLAPSIBLE BOAT POWERED BY A LAND VEHICLE

[76] Inventor: George J. Hanz, 254 Thrasher St., Bloomingdale, Ill. 60108

[21] Appl. No.: 389,587

[22] Filed: Feb. 16, 1995

[51] Int. Cl.[6] ..... B63H 21/175

[52] U.S. Cl. ..... 440/11; 440/5; 114/244

[58] Field of Search ..... 114/150, 344, 114/123, 343, 61; 440/5, 11, 12

[56] References Cited

U.S. PATENT DOCUMENTS

| | | | |
|---|---|---|---|
| 2,334,932 | 11/1943 | Kaloshin | 440/11 |
| 2,994,294 | 8/1961 | Roth | 440/11 |
| 3,067,439 | 12/1962 | Brush . | |
| 3,076,425 | 2/1963 | Anderson . | |
| 3,193,851 | 7/1965 | Fiebelkorn . | |
| 3,332,388 | 7/1967 | Moraski . | |
| 3,414,916 | 12/1968 | Martin et al. | 114/344 |
| 3,587,511 | 6/1971 | Buddrus | 440/5 |
| 3,599,595 | 8/1971 | James | 440/5 |
| 3,828,379 | 8/1974 | Walston . | |
| 3,911,847 | 10/1975 | Worthing | 114/150 |
| 3,987,748 | 10/1976 | Carroll | 440/5 |
| 4,070,978 | 1/1978 | Virgilio | 114/344 |
| 4,269,598 | 5/1981 | Labelle . | |
| 4,354,290 | 10/1982 | Tevruchte et al. . | |
| 4,664,401 | 5/1987 | Carrick | 114/344 |
| 4,781,143 | 11/1988 | Logan . | |
| 4,829,926 | 5/1989 | Voelkel . | |
| 4,899,681 | 2/1990 | Ottsman et al. | 114/230 |
| 4,909,169 | 3/1990 | Skandaliaris et al. . | |
| 5,000,473 | 3/1991 | Johnson . | |

FOREIGN PATENT DOCUMENTS

| | | |
|---|---|---|
| 669001 | 12/1938 | Germany . |

*Primary Examiner*—Stephen Avila
*Attorney, Agent, or Firm*—Gerstman, Ellis & McMillin, Ltd.

[57] ABSTRACT

A trailer/boat is provided which is capable of being towed behind a recreation vehicle or the like, and then prepared without special equipment and launched in a manner capable of receiving the towing vehicle as cargo on the boat. The boat then may be powered and steered from the cab of the vehicle that it carries.

19 Claims, 12 Drawing Sheets

COLLAPSIBLE BOAT POWERED BY A LAND VEHICLE

BACKGROUND OF THE INVENTION

The invention pertains to a boat which is large enough to carry a van, a recreational vehicle camper, or the like, where the motor of the vehicle carried by the boat serves as the power source for the boat propulsion means. Also, the boat of this invention is collapsible so that it can easily be pulled onto a trailer, or the boat itself can be converted into a trailer.

While boats of the type described above are disclosed in Logan U.S. Pat. No. 4,781,143; Anderson U.S. Pat. No. 3,076,425; and Skandaliaris et al. U.S. Pat. No. 4,909,169, numerous disadvantages are found in the prior art units which limit their usefulness, which disadvantages are addressed and greatly improved by this present invention.

DESCRIPTION OF THE INVENTION

By this invention a boat is provided which is convertible to a trailer or is trailer mountable, and which is capable of carrying a vehicle such as a camper or R.V. The boat of this invention is capable of being launched and retrieved from a common type launch ramp associated with trailered boats. The boat also preferable has the capability of quick and easy conversion to a wheeled, land-trailered vehicle. In this process, the beam or width of the boat can be reduced by typically greater than 50 percent from the water mode to the land traveling mode. In the land travelling mode, the boat can have a width which is reduced to less than eight feet, to allow for normal or unrestricted road and highway travel and to maximize its dynamic stability. The length of the boat can also be reduced from the floating mode, to further increase the dynamic stability and maneuverability on land, and to reduce its volume for storage, as well as its convenience for use as a trailer.

The boat of this invention is capable of receiving a road vehicle such as a camper truck or the like, which road vehicle is driven onto the boat after the boat has been launched. Then, the boat is powered primarily by the vehicle, with the boat being driven and controlled from the driver seat of the road vehicle. This can be accomplished with essentially no modifications of the road vehicle itself.

Steering of the boat is accomplished by means of the existing steerage of the road vehicle through contact coupling with the steerable wheels of the vehicle. These steerable wheels engage steering mechanism platforms of the boat, which engagement requires no modifications of the vehicle. Engagement of the steerable wheels with the steering mechanism platforms is typically maintained by the weight and the fixed position of the vehicle. Thus, normal steering from the steering wheel of the vehicle converts by means of a mechanical or hydromechanical linkage to steering by one or more rudders or propellers of the boat.

The propulsion system for the boat draws its power from the drive wheels of the land vehicle. While Anderson U.S. Pat. No. 3,076,425 shows such a drive system, and a similar steering system, improvements are provided by this invention, utilizing a hydraulic motor which engages one or more of the drive wheels with a selected, controlled pressure independent of the weight of the vehicle, to achieve significant improvements and advantages. Thus, the boat speed and direction may be controlled from the driver's seat of the land vehicle.

Further in accordance with this invention, stabilizer bars are provided to extend from the bow of the boat, and to press with wheels downwardly to hold typically the bow of the boat in a vertically stable position. Thus, a vehicle can be driven onto the boat while the bow of the boat remains vertically stable.

Also, a novel tow bar is disclosed.

DESCRIPTION OF SPECIFIC EMBODIMENTS

Figure 1:
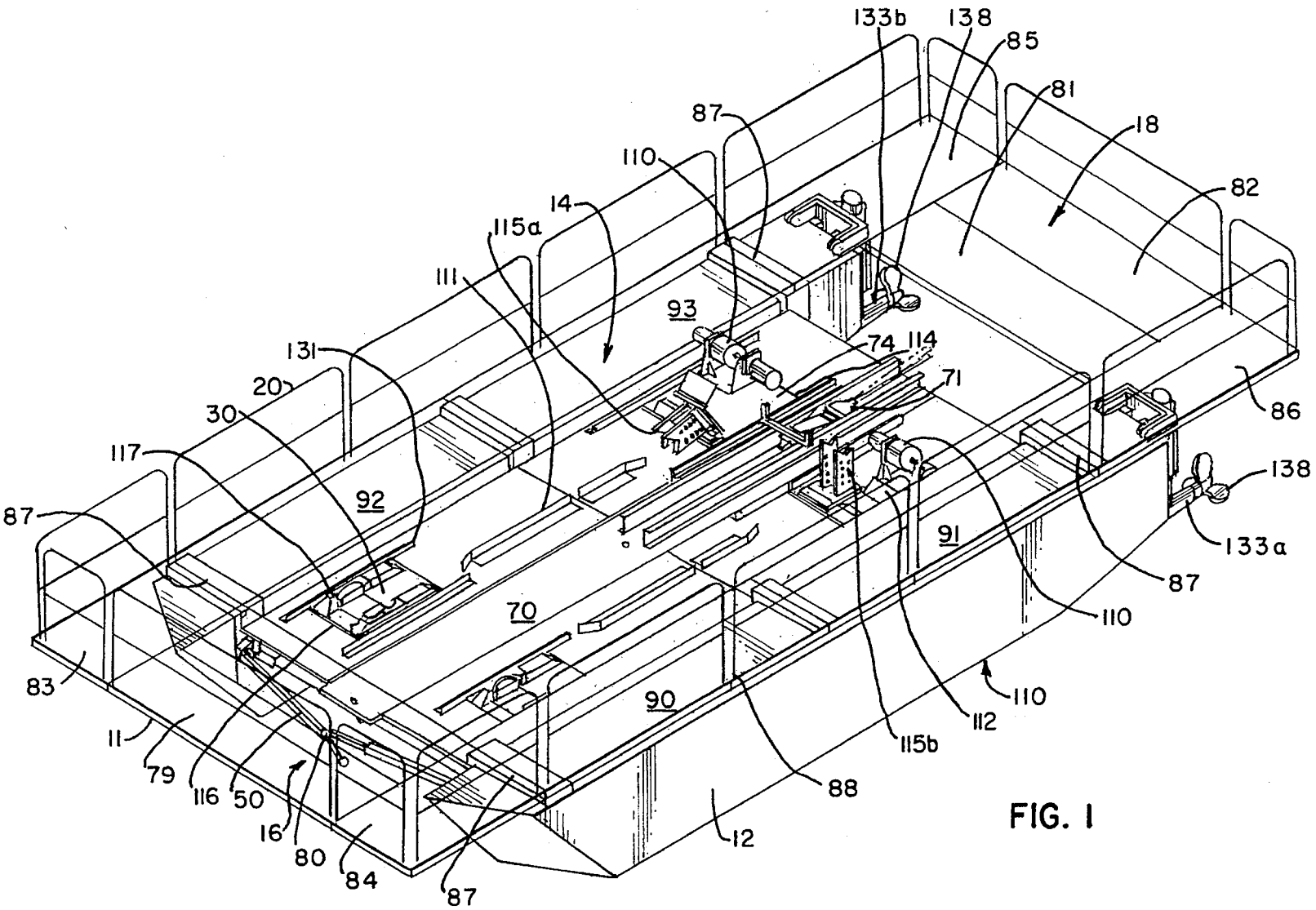
FIG. 1 is a perspective view of the boat of this invention.

Referring to FIG. 1, pontoon boat 10 is shown having a pair of pontoons 12, a central deck 14, a bow deck 16, and a stern deck 18. Hand railings 20 extend about the boat.

Boat 10 also defines seats or platforms 116 for the front wheels of an automobile, plus pivotally movable supports 115*a*, 115*b* for supporting the rear axle of a vehicle carried on the boat, to permit the rear, powered wheels of the vehicle to engage the power takeoff rollers 110, all in a manner to be described below.

The collapsible and extendible frame is composed of three identical beams 99 that are placed parallel to each other and transverse to the boat beam. Structurally they perform as simply supported beams with end reactions from concentrated load forces displaced along the beam. These are the primary forces exerted on the beam and are caused by the land vehicle load transferred through the tires and the reaction of the water displacement loads transferred through the pontoons 12.

Figure 3:
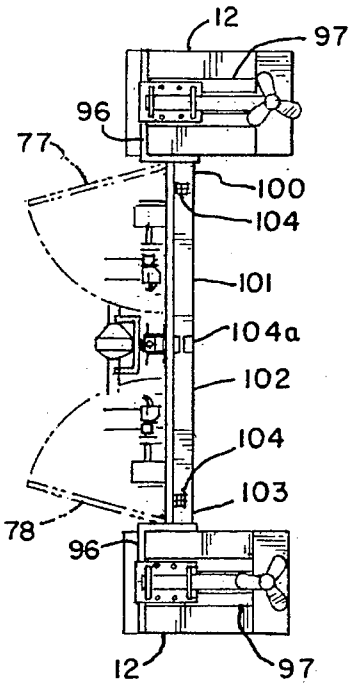
FIG. 3 is a rear elevational view of the boat of this invention, showing it in its laterally expanded position of use.
Figure 4:
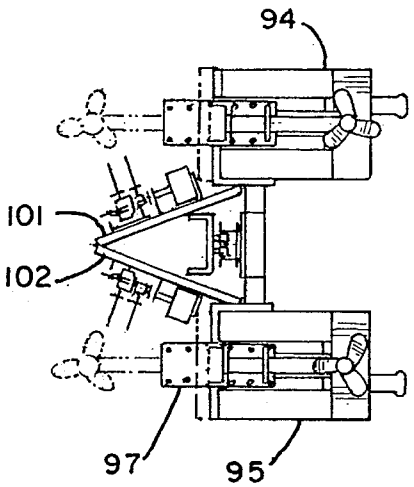
FIG. 4 is a rear elevational view of the boat of FIG. 3 shown in its laterally collapsed, trailer position.
Figure 4A:
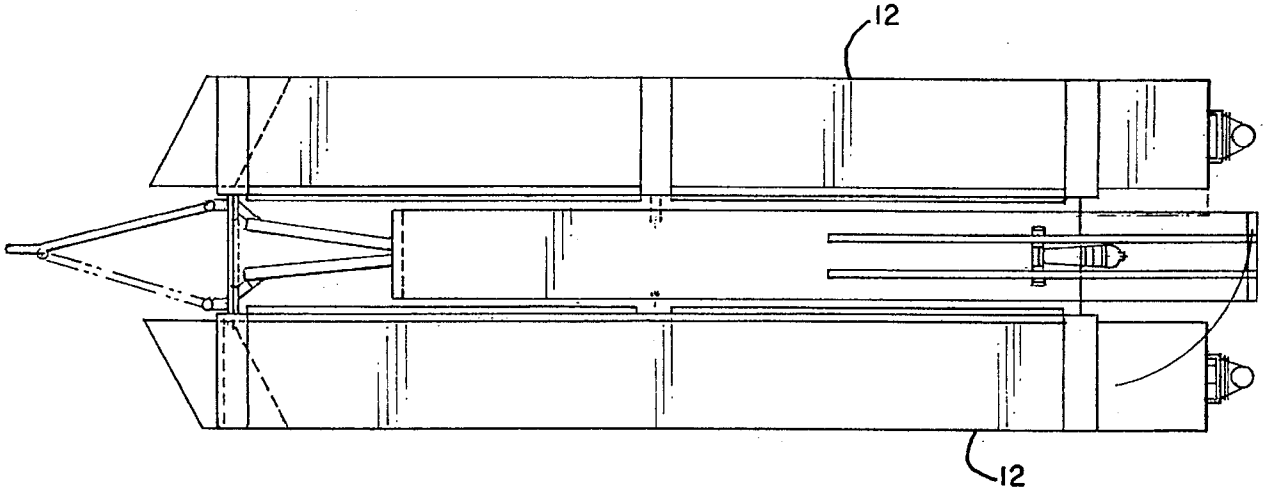
FIG. 4A is a plan view of the boat of FIG. 2 shown in its laterally collapsed, trailer position.

The beams are composed of four coaxial sections (FIG. 3) 100, 101, 102, 103, connected by three hinged articulated joints 104, 104*a* that are parallel to each other. The two end hinged joint 104 are on the same side of the beam, while the center hinged joint 104*a* is on the opposite side of the beam. This configuration allows for the two adjacent central sections 101, 102 of the beam to fold onto themselves as the two outer Sections 100, 103 travel towards each other (FIG. 4) when laterally collapsing the boat. The reverse is true when laterally extending the boat.

Figure 5:
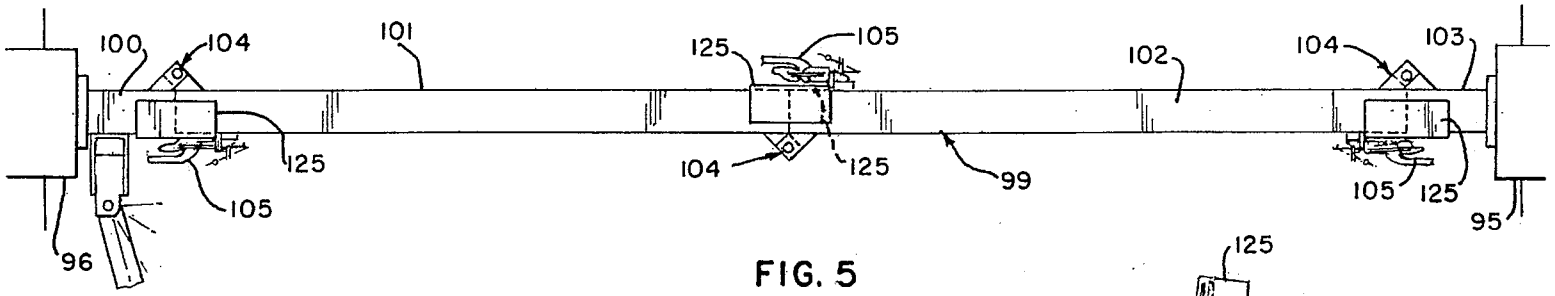
FIG. 5 shows a plan view of a transverse beam 99.
Figure 5A:
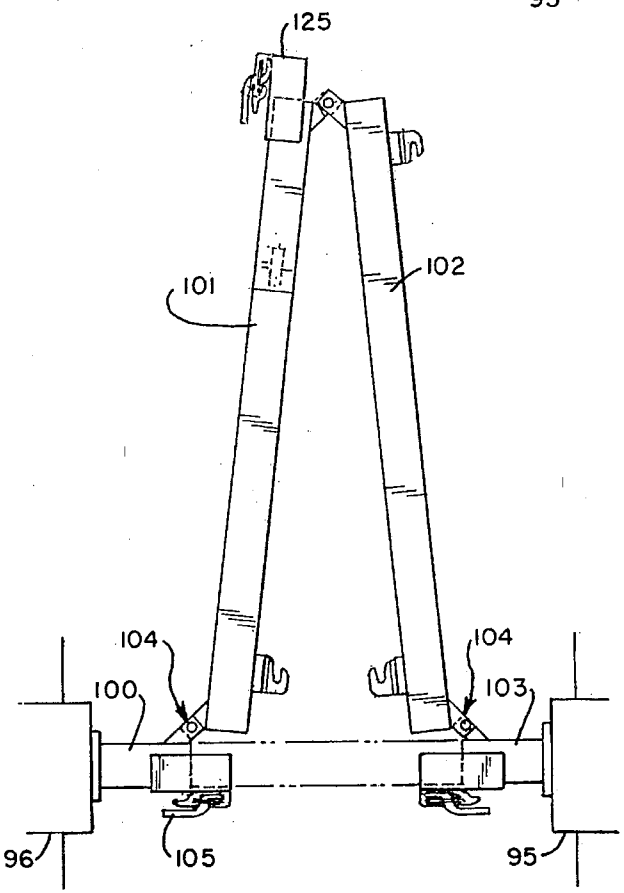
FIG. 5A shows an elevational view of the transverse beam of FIG. 5 in a laterally collapsed configuration.

The pontoons 12 are attached to end (or outer) sections 100, 103, each pontoon being attached on the same ends of all the beams 99. On the opposite side to the hinges 104, 104*a* is a set of toggle clamps 105, seen in FIG. 5. When in their holding (clamping) position, they maintain the beams 99 in their rigid and inline form and carry, in conjunction with the hinges, the bending forces generated by the land vehicle and the pontoons. These toggle clamps 105 can be of the manual actuated type or actuated by hydraulic or pneumatic cylinders.

Figure 6:
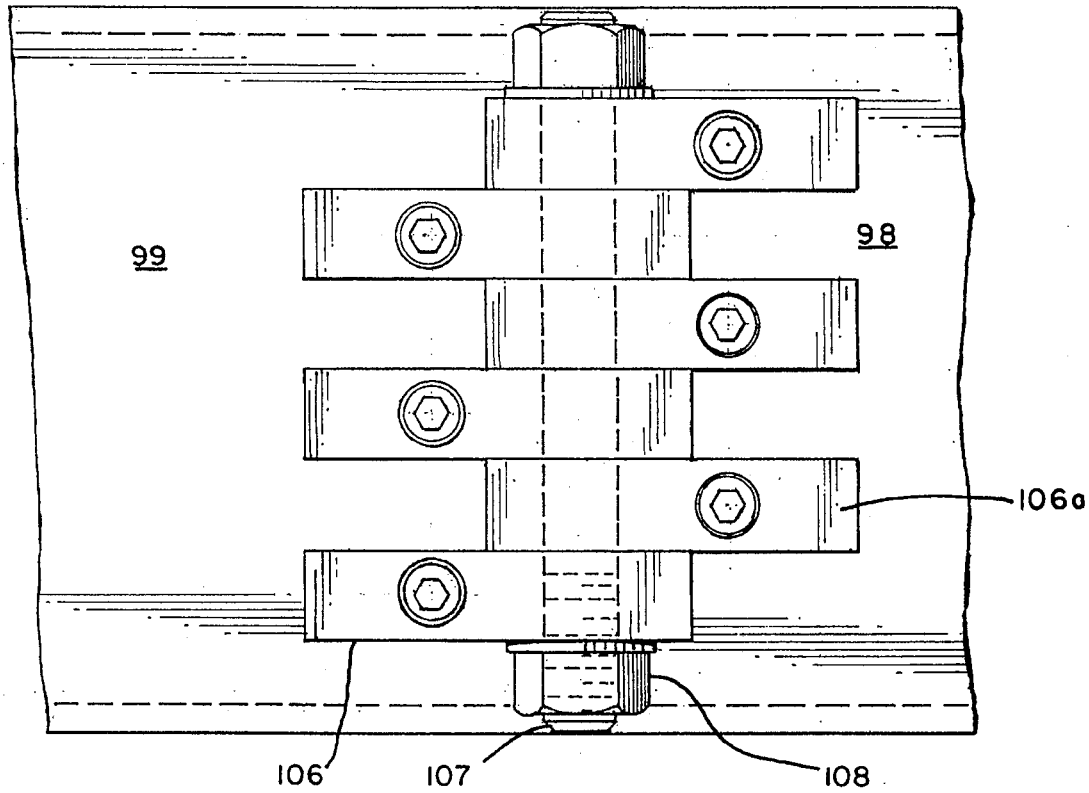
FIG. 6 is a plan view of a portion of beam 99.
Figure 7:
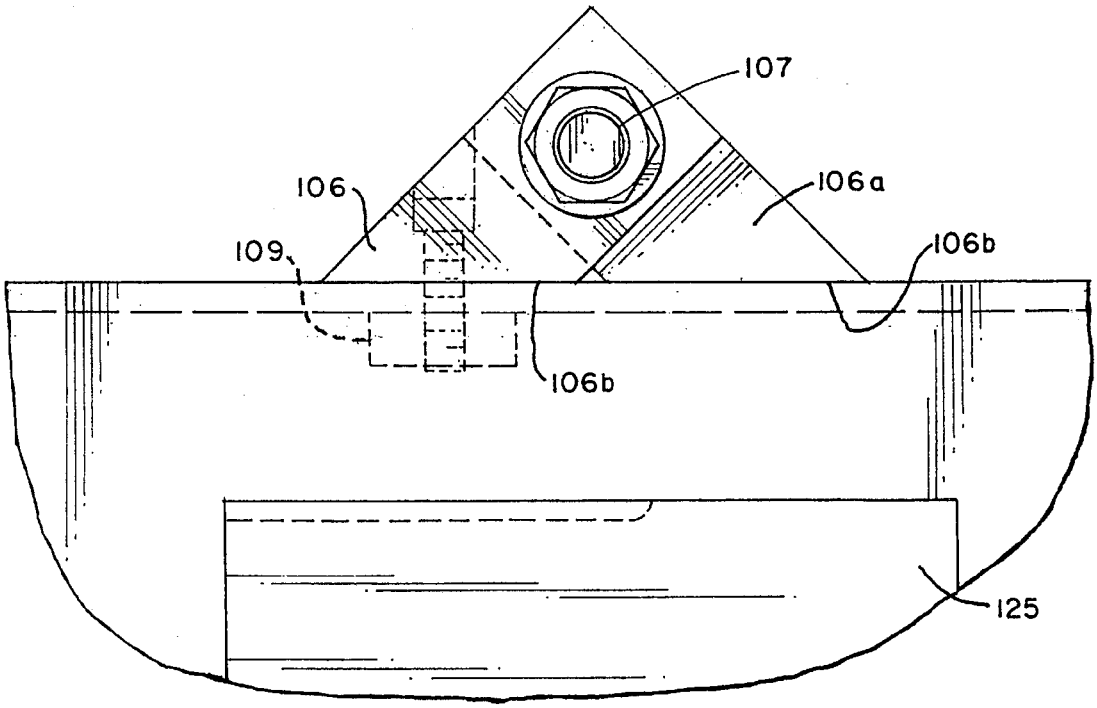
FIG. 7 is a further elevational view of the beam portion shown in FIG. 6.

The hinges 104, 104*a* comprise multiple plates 106, with every other plate attached to the adjacent section of the beams 99. The other ends of the plates have holes that receive the hinge pins 107 (FIG. 6). Each pin is held in place by nuts 108 at their ends. The hinge plates 106 are held to the sections 100, 101, 102, 103 with screws and nut plates 109 (FIG. 7).

On the side of sections 100, 101, 103, opposite the hinge 104 and to which toggle clamps 105 are mounted, brackets 125, (FIG. 5) are L-shaped in cross section and are welded or otherwise attached to the side of the section, one on each side of the abutting joint between sections and extending 90° over the adjacent wall section under toggle clamp 105. Brackets 125 for each joint are separately located and attached to the outer surface of one of sections 100, 101, 103, to overlie the adjacent section 102, etc. for support of the joint. There is no clearance or play between brackets 125 and the adjacent section which they overlap. This effects a structural joint that is highly efficient and permits only minimal deflection and deformation of the sections of beams 99.

The pontoons 12 are the elements of the boat that provide the means for floatation. They are laterally displaced at the extremes of the port and starboard sides of the boat. With the major weight (the land vehicle) centered between these pontoons, the boat is in its most stable configuration. The pontoon cross-sectional shape is preferably that of a vertical (quadrilateral) rectangle, the longer axis (or sides) being vertical. This shape and position allows for the greatest pontoon volume without increasing the width of preferable 6 to 9 feet when collapsed for road travel, typically 8 feet. The pontoon walls are flat, to provide the most economical shape. They can be made from commercially available plate and sheet stock.

A complete pontoon 12 can be composed of an optimal number of panels butt jointed and welded. The internal skeletal frame of pontoon 12 provides a substrate for the butt joints for welding and to increase the strength, while allowing thinner walls for lower weight and cost. The pontoon has an external frame 96 (FIG. 3) that is attached to the inboard and topside surfaces. This frame provides the attachment places for the passenger deck and the vehicle hinged deck, and also the structural frame.

Figure 2:
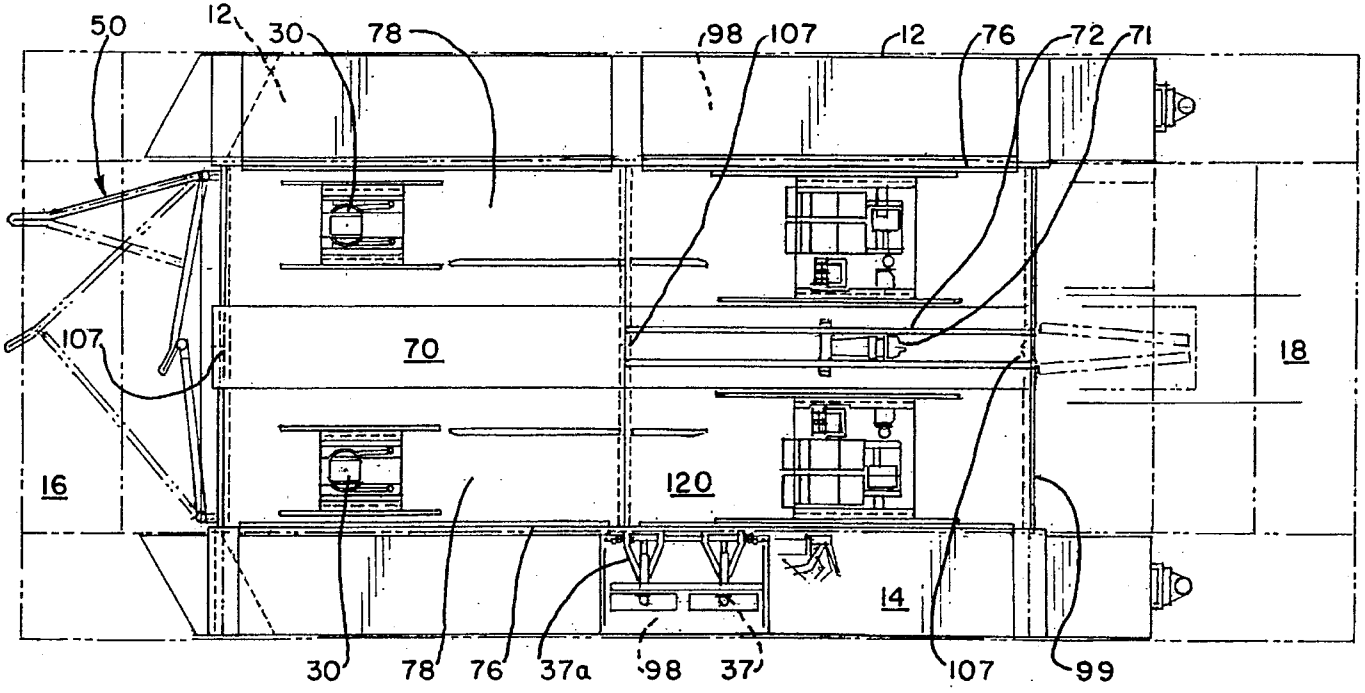
FIG. 2 is a plan view of the boat of this invention.

Since the pontoon is a thin shell structure, the external frame 96 (FIG. 3) distributes the forces from the structural frame over a broader area of the pontoon shell. Otherwise concentrated loads would collapse the thin walls. This also applies to the stern panel that has channels 97 attached for mounting the propeller drive. At about the midsection of the pontoon, chambers 98 (FIG. 2) are defined open to the underside and closed on top. Each chamber 98 contains a wheel bogie 37*a* with vertical motion mechanism to raise and lower the wheels 37. Chamber 98 has walls that are an integral part of the pontoon chamber, and are sealed against the water. Chamber 98 can be gas (air) pressurized to lower the water level in it, to provide additional buoyancy, and to balance the boat and load. Thus, Chambers 98 can act as ballast chambers.

Passenger deck 14, 16, 18 is continuous about the perimeter of the land vehicle, and is attached to pontoons 12 and each adjacent section. The bow and stern deck sections 79, 80, 81, 82 are removable to allow the boat to be configured for land travel. These sections are stored elsewhere on the boat or on the land vehicle. The forwardmost and rearwardmost port and starboard sections 83, 84, 85, 86 are hinged at 87 to fixed adjacent port sections 90, 91 and starboard sections 92, 93 so as to allow them to be folded and thereby to reduce the overall length of the boat during land travel. Those hinged sections which are normally cantilevered over the bow and stern ends of the pontoons preferably have supporting structures attached to then to counteract these forces.

Spaced along the perimeter are brackets 88, attached to the decks so that guard rails 20 can be attached and easily removed for land and water travel, as desired.

The central support area also comprises foldable sections in an arrangement that allows the least size for ease of movement and least volume during land travel. The mid section 70 is the narrowest of such sections, and runs the full length of the vehicle deck. It is attached at each hinge pin 107 of the center joint of the collapsible frame beam sections 101, 102. These joints maintain alignment and synchronize the motion of the boat when it is extended or collapsed for land or water deployment. Mounted to this section is the vehicle lifting jack 71 and the beam frame 72 (FIGS. 2 and 8) that supports it and transfers its load to the two adjacent frame beams 99. This frame 72 also provides the adjustment to align the jack with the vehicle drive axle. On the underside of the deck, below the jack frame, is a truss support 73, (FIG. 8) running the full length between two frame beams 99. This truss 73 along with the jack beams 72, support the vehicle load when the jack is used to raise and lower the vehicle axle. This truss 73 is attached to the deck section 70.

The two stern end sections 76 (FIG. 2) are each hinged to their respective port and starboard pontoons 12. Mounted onto each is the input unit of the propeller drive (FIG. 15) which is composed of the power takeoff drum 110, hydraulic pump 210, vehicle wheel cradle 112, axle cradle 115, etc.

The two bow end sections 78 (FIG. 2) are each configured like the stern sections 76. Mounted onto each section 77, 78 is each steering wheel platform input plate 30 of the propeller steerage, which is described elsewhere.

The hinging of these end sections 76, 78 allows for the collapsing of the boat when configured for land travel. They are raised to a near vertical position before the frame beams are folded and fastened in this position with brackets. All hydraulic hoses attached to or passing through these deck sections are of proper orientation and sufficient slack to allow these motions.

Figure 9:
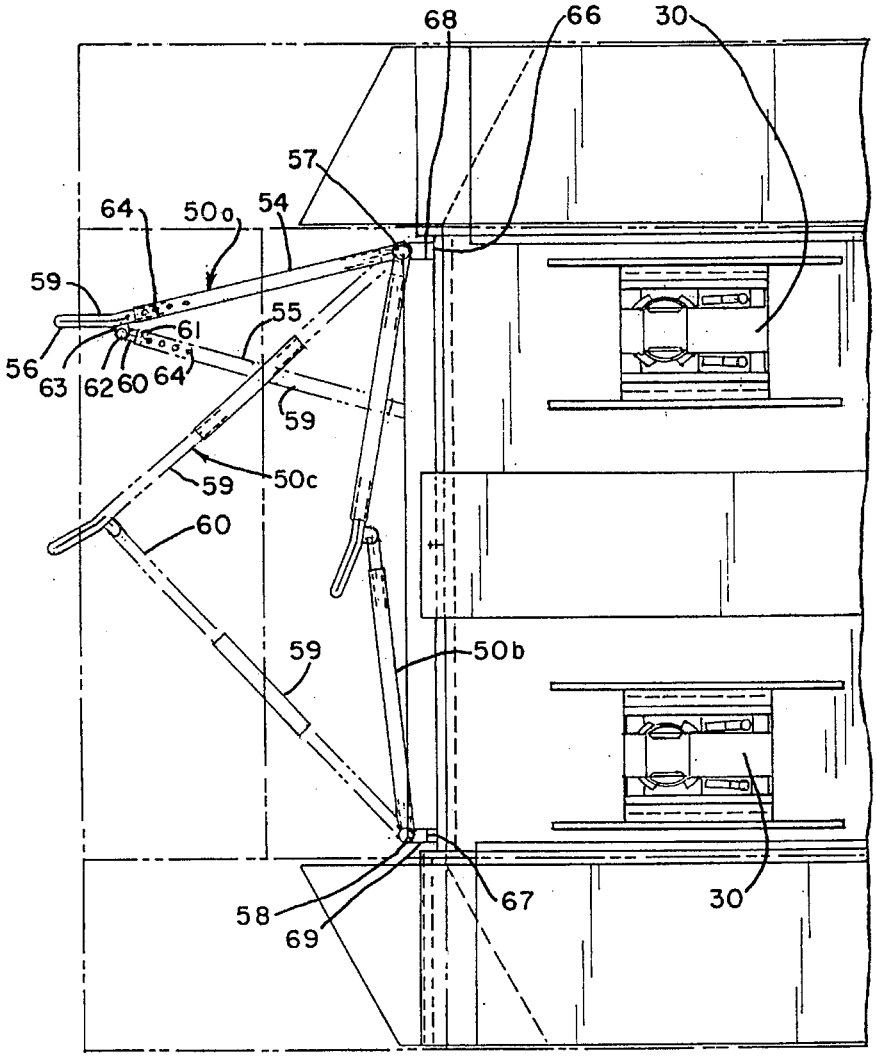
FIG. 9 is a plan view of the bow of the boat of the previous drawings showing the tow bar.
Figure 10:
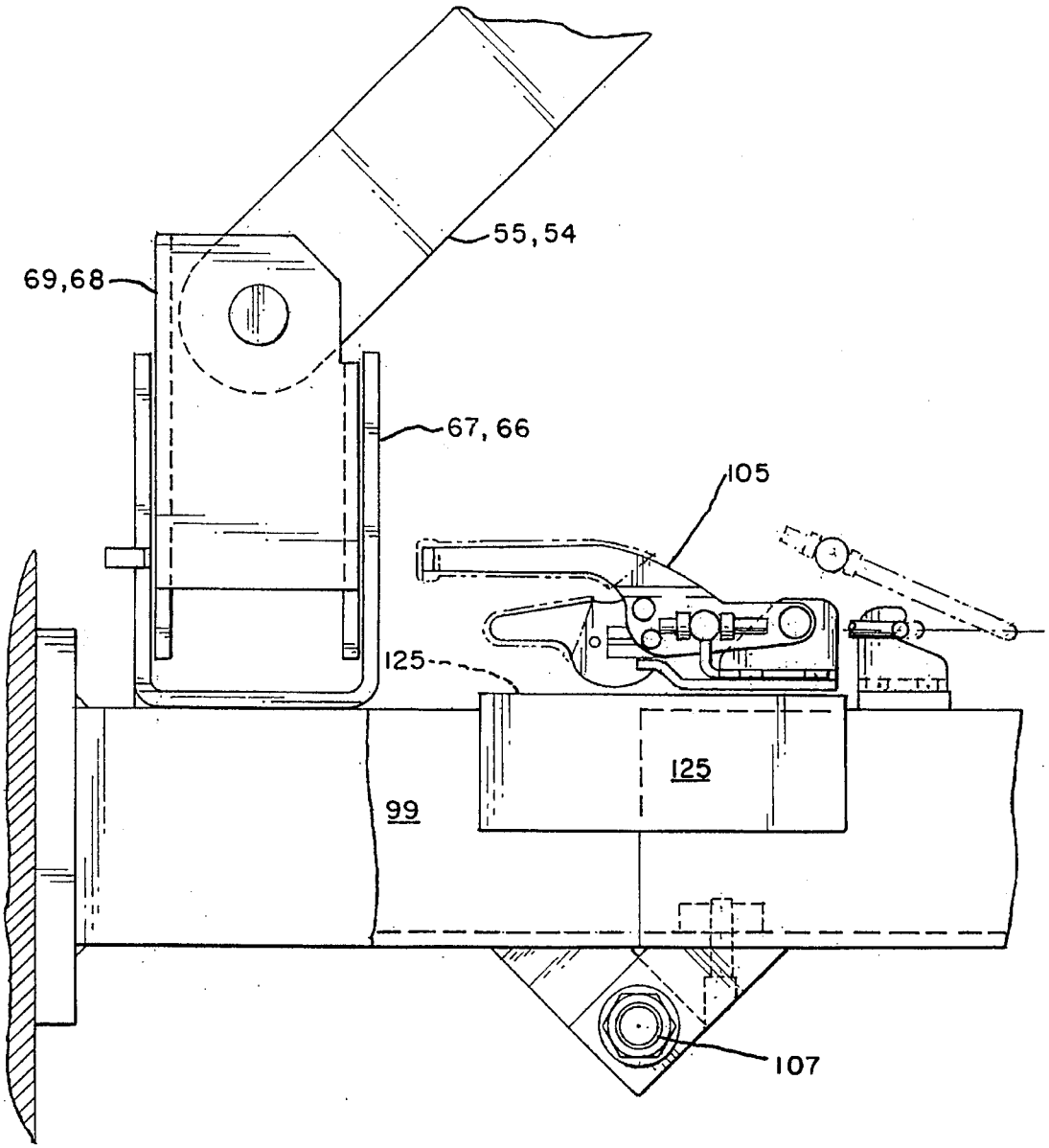
FIG. 10 is an enlarged plan view of a portion of the bow area of the boat.

A collapsible tow bar 50 provides the means to attach and trail boat 10 behind typically the land vehicle that the boat carries. Tow bar 50*b* is shown in its waterborne storage mode in FIG. 9, while the same tow bar 50*a* is shown in its land trailing position, permitting the boat to be laterally collapsed. Position 50*c* is the boat launching position. The features of the tow bar 50 are to accommodate the special requirements of the boat. The tow bar is permanently attached to the boat, and must laterally collapse and extend with the pontoons as they are reconfigured for land and water travel. Both tow beams 54, 55 between the ball 56 and the vertical pivot brackets 57, 58 at each pontoon are composed of telescoping tubes 59, 60 respectively. This feature allows for parting or joining of the pontoons 23 as the land vehicle supports the bow of the boat. Since the distance between the land vehicle and the boat can remain fixed, and the distance between the beam ends attached to the pontoons varies as they are brought together or separated, it is necessary to shorten or lengthen the beams. With telescoping beams 59, 60 it is possible to shorten or lengthen them and support the load simultaneously.

This feature allows for only one pontoon to be moved when the pontoons are separated or joined. During the joining operation, after the boat is taken out of the water and is on land, one or both tow bar telescoping joints 61 are released to allow for independent movement of the telescoping tubes 59, 60. Then the land vehicle will be moved forward and laterally to a position it would occupy when land towing. This position maneuver is required so that when bringing the pontoons together, the pontoon being moved will not contact the adjacent tow beam.

The tow ball joint socket 56 is of a common ball and socket design, with the ball being affixed to the rear of the land vehicle in a conventional form. The socket 56 is affixed to the end of one telescoping tube 59 that has adjacent to it the pivotal joint 62 of the other telescoping tube 58. At this juncture there is an offset 63 of the joint 62, to allow for collapsing of the tow bar to be positioned adjacent to the boat folding beam structure to which it is attached. The mating, telescoping tubes 59, 60 have a plurality of holes 64 placed longitudinally at points which place the extended or collapsed beams in the proper position for towing or storage. Pins are placed through these aligned holes and latched in position.

The joints affixing the tow beams to the boat folding beam is configured to allow two degrees of rotary freedom. A vertical movement slide (brackets 66, 67) and a horizontal movement slide (brackets 68, 69) allows folding and tilting, which is required for storage and vertical alignment between the tow vehicle and boat for proper land towing. This vertical free motion is also required for entering and exiting the boat to and from the water.

Figure 11A:
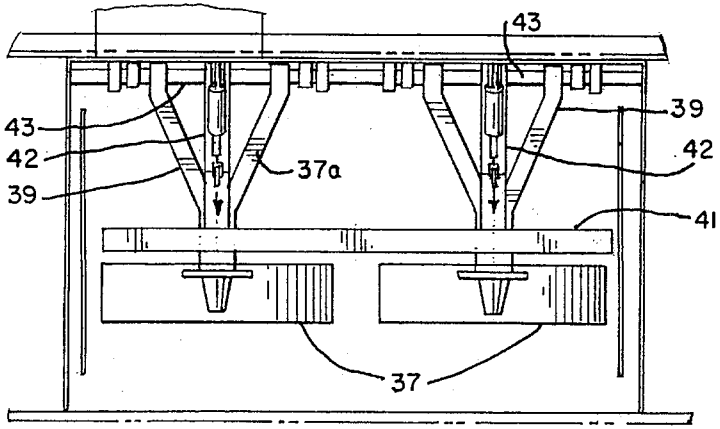
FIGS. 11A–11C are respectively a plan view, an elevational view, and a transverse sectional view of a set of bogie wheels and a wheel housing of the boat of the previous drawings.
Figure 11C:
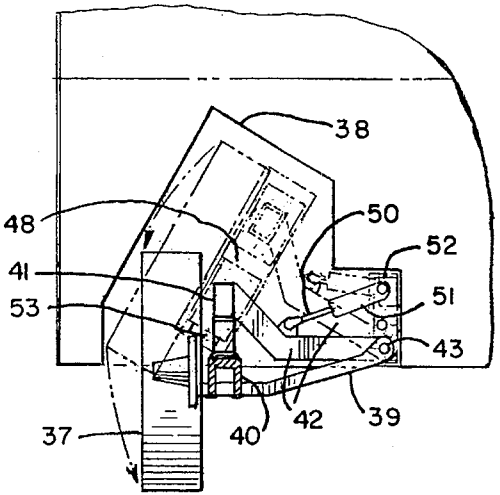

For land trailing, the boat is configured with wheels 37 (FIGS. 2, 8, and 11) approximately midship in wheel well 98 set in each pontoon, as previously described. The separate wheels 37 are attached to independent yokes 39 that are pivoted at one end and fixed to springs 40 adjacent to the wheel 37 at the other end. The independent spring 40 of each yoke 39 is attached to a single tube frame 41. The single tube frame 41 has two laterally extended tubular arms 42 with ends configured to pivot concentrically about the same axle 43 as the wheel yokes 39.

Figure 11B:
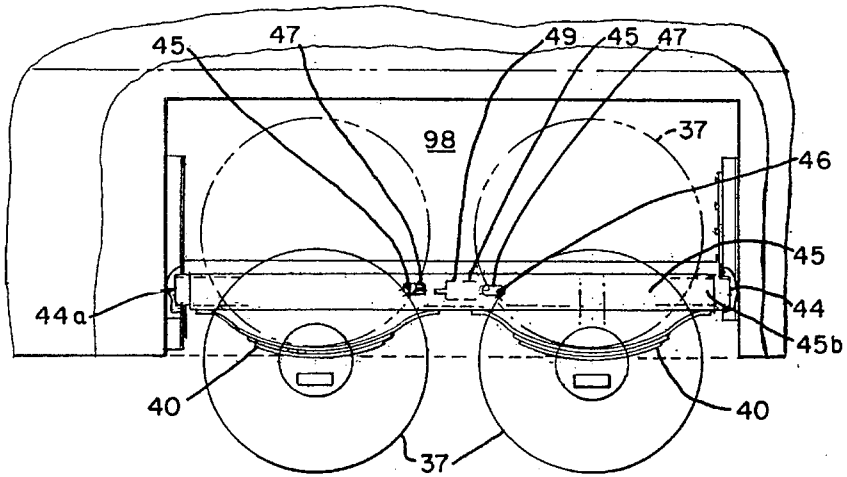

This tubular beam frame 41 has within it telescoping latching tubes 44, 44*a* that are attached to a hydraulic cylinder 45 between them. One tube 44 is attached to the cylinder end 45*b*, and the other tube 44*a* is attached to the piston rod end 49. The latching tubes 44, 44*a* are keyed to the tube frame 41 by pin 46 and slot 47 to control the travel of the latching tube 44. By fully extending the hydraulic cylinder 45, each latching tube 44 will travel the full length of the slot 47, regardless of which latching tube begins or finishes first or last. This assures that both latching tubes 44, 44*a* extend beyond or retract within the ends of the tube frame 41 by a fixed amount. When extended, these latching tubes 44, 44*a* will engage similarly shaped openings in plates 48 attached to the walls of the pontoon wheel wells 98. When they are engaged it fixes the wheel bogies 37 to either of the two positions, lowered or retracted. The lower position, shown in full lines in FIG. 11*b*, is for extending the wheels for land trailing. The upper position, shown in broken lines is the retracted position of the wheel bogies 37 for water transport.

The actuator effecting the motion of the wheel bogies 37*a* are hydraulic cylinders 51 (FIG. 11*c*) with end attachments offset from the pivotal axis 43 of the beam frame 41. The piston rod is attached to the tubular arm 42 of frame 41, and the cylinder 51 attached to the pivot mount 52. Two cylinders are configured in this arrangement, one connected to each of the two tubular arms 42, to operate in synchronism for lifting and lowering the wheel bogie assembly 37*a*. There are physical stops 53 at the end of travel of the tube frame 41 to effect proper alignment with the latching holes.

Figure 12:
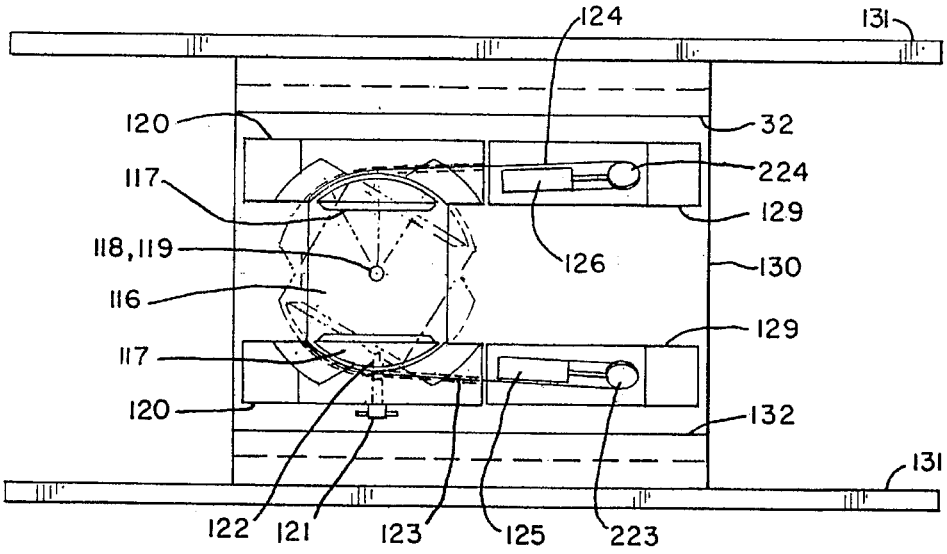
FIG. 12 is a highly enlarged plan view of the front vehicle wheel housing design of the boat of the previous drawings.

The steerable front wheels of the boarding vehicle carried on boat 10 are driven onto the pivotal platforms 116 and bracketed by the attached tire guides 117 (FIGS. 1 and 12). At this position, the vehicle wheel rotates horizontally with the platform 116. The platform 116 is restricted to one degree of freedom of a rotational motion by a pin 118 and socket 119 so that platform 116 is rotatably carried on a flange of the bridge or mounting base 120. Bridge 120 has a locking device pin 121 which fits into socket 122 of platform 116. Pin 121 is releasable, to maintain proper position and prevent platform movement when boarding and unboarding of the vehicle.

Attached to the circumference of the platform is a cable (FIG. 12) having sections 123, 124 that cause a pulling force on rotary platform 116 in one direction or other, while simultaneously slacking in the opposite direction. The pulling force in rotary motion causes the piston of hydraulic cylinder 125 to retract at a travel ratio of one-half that of the cable motion due to the multiple wrap of the pulley 223 and cable 123, pulley 223 being carried on the piston of cylinder 125. Simultaneously the opposing cable 124 is allowed to slacken allowing the opposing cylinder 126 to extend. This motion is reversed when turning the vehicle steering in the opposite direction. The piston of cylinder 126 also carries a pulley 224, about which cable 124 is wrapped.

Figure 13:
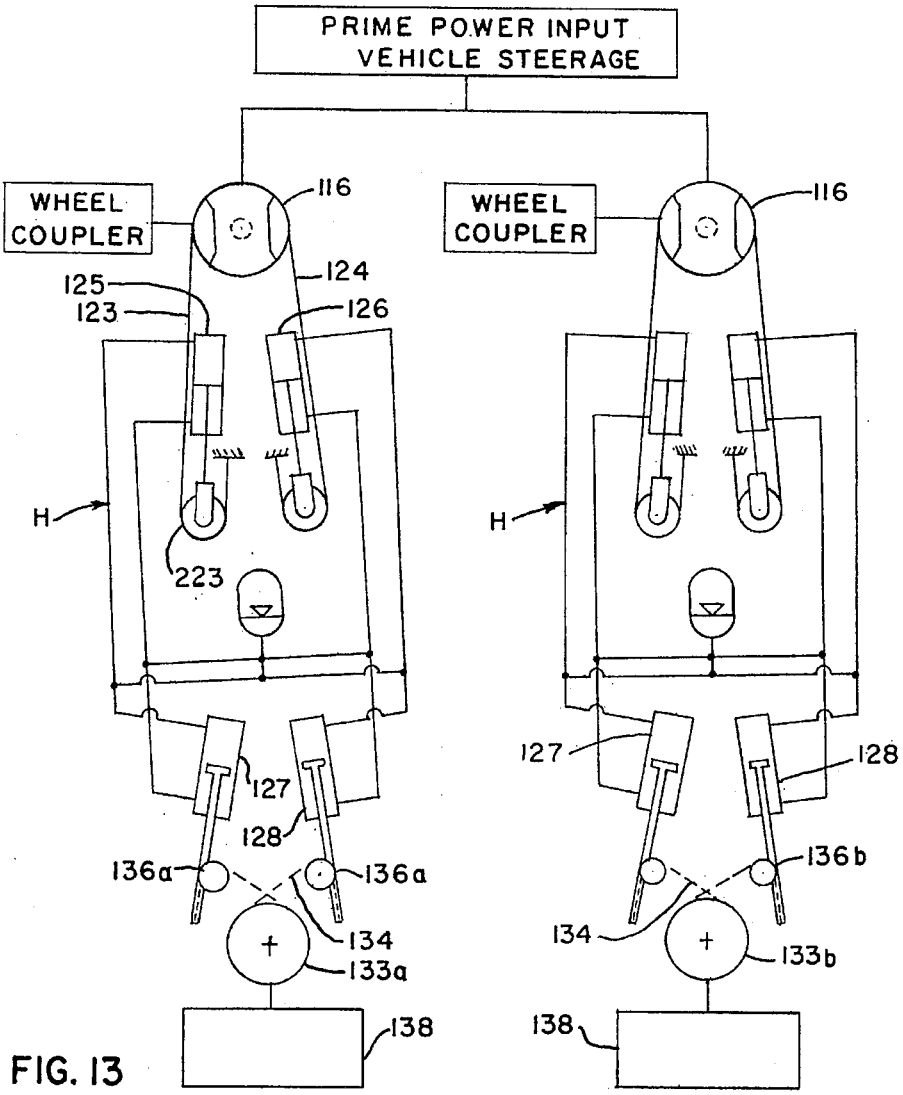
FIG. 13 is a diagrammatic view of the boat steering mechanism.

This reciprocating action causes a separate set of cylinders 127, 128 (FIG. 13), connected hydraulically to cylinders 125, 126, to operate in a synchronized motion to steer the propeller drive for turning. This is accomplished by means of a closed loop hydraulic circuit H.

The bridge 120 in addition to retaining the steering platform 116, permits rear dual wheels of a carried vehicle to pass over the steering device in a smooth and unobstructing way. As a continuation of this bridge, a separate, inclined cover 129 is placed over the steering cylinders 125, 126 and pulleys 223, 224 as a protective device. This aids in providing continuous, smooth passage of the vehicle wheels. A non-dual wheeled vehicle will pass freely between the tire guides 117 of the platform 116. These tire guides 117 aid alignment and also the transmission of torque from the vehicle steerable wheels, being carried by platform 116.

The above described mechanism including platform 116 is mounted to a plate type adjustable base 130 movable along fixed rails 131, that will allow adjustment for varying wheel bases and will allow shifting of the vehicle center of gravity to trim the boat for an even keel. Fixed rails 131 are attached to the vehicle deck to fasten the steering assembly to the boat. There is an intermediate bracket 132 between the platform 130 and the fixed rails 131 to facilitate attachment and to allow transverse alignment motion of the steering assembly including platform 116 along rails 131 for varying according to the transverse wheel spacing in the mounted motor vehicle. Since flexible hydraulic hoses may be used in hydraulic system H, this adjustable spacing becomes possible along with the steering control provided by the system of FIGS. 12 and 13.

Boat steering is accomplished by rotation of the boat propeller housings 133*a* and 133*b* (FIG. 1). Two hydraulic steering systems are shown, one for each wheel. Thus, no rudder is required. In each system, the two opposed hydraulic cylinders 127, 128 (FIG. 13) are connected to a cable 134, which is attached to the ends of the piston rods of pistons 127, 128 and respectively wrapped around each propeller drive housing 133*a*, 133*b* on pulleys 136*a*, 136*b*, mounted on the housing. This replicates the motion of the vehicle wheel steering device 116 in the operation of extending one cylinder while retracting the other, to steer the boat propellers 138.

The propeller drive housings 133*a*, and 133*b* are supported by bearings which allow it to be rotated about each axis for steering (turning) purposes.

Figure 8:
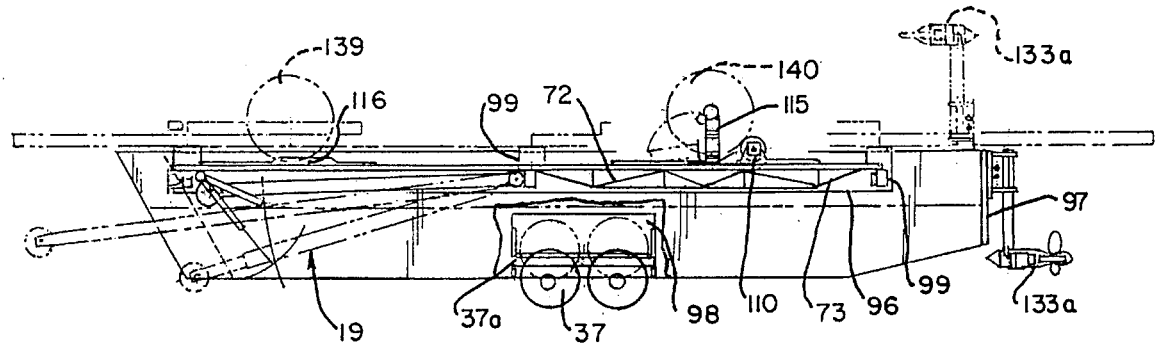
FIG. 8 is an elevational view of the boat of the previous drawings.

The drive mechanism for propellers 138 comes from the wheels of the vehicle carried on the boat. The rear tires 140 (FIG. 8) are positioned with the vehicle axle resting on top of axle cradles 115*a* and *b*. Front tires 139 rest on steering platforms 116. Axle cradle 115*a* (FIG. 1) is shown in the folded, storage position, being pivotally attached to the deck of the boat, and may be placed in the vertical position for use as shown by axle cradle 115*b*. In this position, as shown in FIG. 8, the vehicle power wheels 140 engage the power takeoff drums 110, shown in FIGS. 1 and 8.

Figure 14:
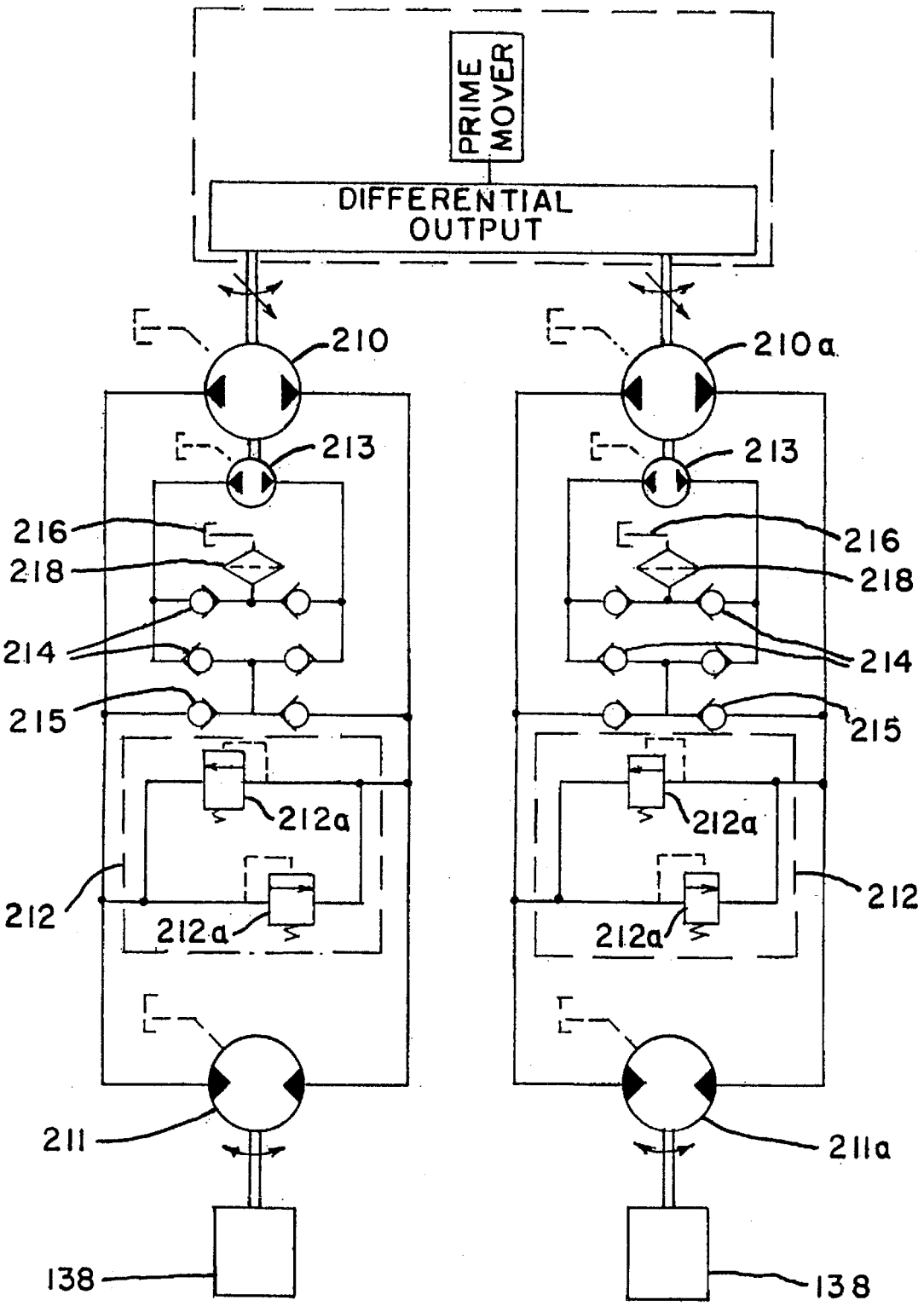
FIG. 14 is a diagrammatic view of the boat mechanism for transmitting power from the vehicle wheels to the boat propellers.

A hydraulic power transmission system is shown in FIG. 14, illustrating how power is transferred from power takeoff drums 110 to the boat propellers 138.

The hydrostatic power transmission system which receives input power is primarily configured as dual parallel drives 210, to use and balance the output of both wheels of the vehicle's differential drive axle. The system can also operate in a mode with the vehicle output of one wheel used, with the other locked. This will double the speed of the single drive wheel.

The circuit is composed of hydraulic gear pumps 210, 210*a* of the external gear tooth type with bidirectional pumping capability as the input device. The pumps transfer fluid to the hydraulic motors 211, 211*a* as the output device, which may be similar gear pumps, one pump for each boat propeller 138. The fluid thereafter returns to the pump input port, completing the circuit. Such pumps/motors may be obtained from Hydreco Inc. of Augusta, Ga.

Each pump 210 is connected to a separate power take-off drum 110, which is driven by the separate, powered tires 140 of the land vehicle. Hydraulic motors 211, 211*a* respectively are coupled to the shafts of propellers 138.

This system is a closed-circuit type, which preferably does not have a reservoir in series with the circuit. Each primary circuit, which is composed of the high pressure side and the return (low pressure) side, is capable of being reversed, producing counter-rotation motion in propellers 138.

Connected between the pressure and return sides of the circuit is a pressure relief circuit 212 composed of two opposed relief valves 212*a* in parallel, to allow excess pressure relief to whichever side of the primary circuit is pressurized.

Secondary open circuits are connected between the primary circuit sides and are to provide makeup fluid to the low (or return) side of the primary circuit. Each makeup circuit is composed of a low capacity, bidirectional gear pump 213 with directional (check) valves 214 in a bridge configuration, which provides low pressure fluid to the return (low-pressure) side of the primary circuit in either direction of rotation of the makeup pump 213. The pressurized fluid enters the low pressure line through a directional (check) valve 215 whenever that line becomes the return (low pressure) line, which occurs after a reversal of the primary circuit. The two opposed directional valves 215 through which the pressurized makeup fluid enters between will prevent fluid from the high pressure side from entering the low pressure side regardless of reversing directions.

This pair of circuits shown in FIG. 14 is designed to operate without the use of a fluid reservoir which would require about three times the capacity of the maximum pump output in gallons per minute. The reservoir 216 for the makeup pump can be relatively small, approximately one-quarter or preferably one-sixth that of the system fluid capacity. Reservoir 216 communicates with valves 214 through a filter 218. This system therefore provides the lightest weight bidirectional power transmission for the operation of a weight critical device such as the towable boat for which it has been designed.

The circuits are in a dual (multiple) arrangement and are driven from the output of a dual shaft differential. It may be employed as a single input/output device.

As the land vehicle is driven backwards onto the boat, and the guidance is provided by the guide rails 111, the rear drive wheels are driven onto the wheel cradles 112, which provide a positive alignment for the rear axle and the arcing lift jack 71, of conventional design. The arcing lift jack, which is fitted with a axle lift yoke 74, is raised and engages the vehicle axle. The arcing motion of the jack allows the vehicle wheels to be raised without interfering with the power take-off drum 110 and permits wheels 140 to be lowered onto the axle cradles 115 for controlled contact with the drum. The vehicle axle is raised to a position that allows the hinged, adjustable support cradles 115*a*, 115*b* to be lifted upright from the clearance position (as in 115*a*) to that of the support position (as in 115*b*). Then the arcing lift jack 71 is lowered to allow the vehicle axle to engage and rest on the support cradle.

The positioning and adjustment of the support cradle 115 and the power take-off drum 110, permits most of the full load of the vehicle to be supported by cradles 115. Thus the vehicle wheels 40 do not have to bear against the power take-off drum 110 with a load dependent on the vehicle weight, but rather with a smaller predetermined, controllable load. Thus, the drive mechanism can be smaller and lighter, with less inertia, allowing more rapid acceleration and reversals in direction.

Figure 15:
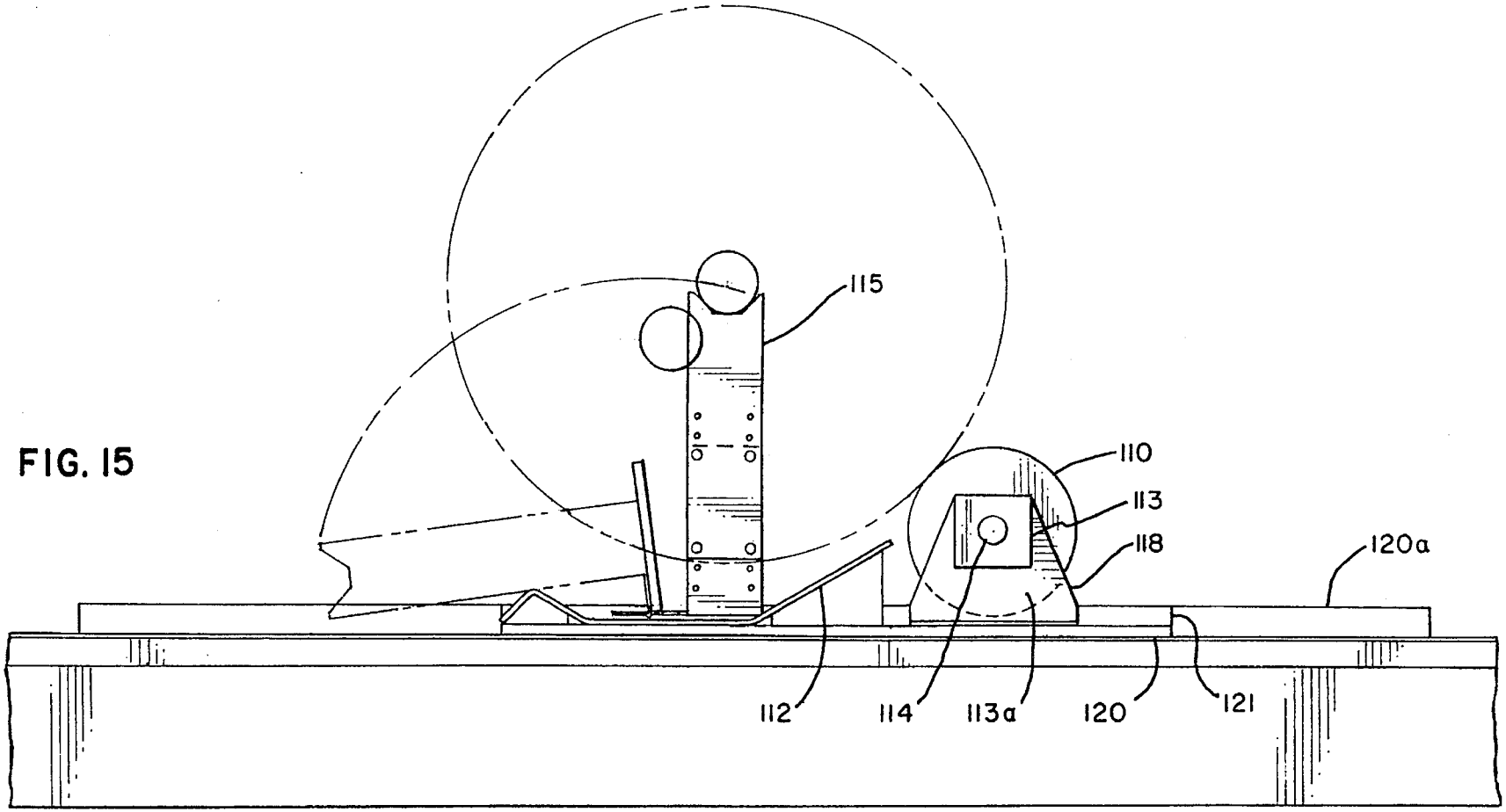
FIG. 15 is a highly enlarged longitudinal sectional view of the powered vehicle wheel cradle and power takeoff system of the boat.

The shaft 114 (FIG. 15) that carries the power take-off drum 110, hydraulic pump 210, and hydraulic makeup pump 213 may be mounted on and coupled to is supported by the bearings 113 and mounting frame 113*a*. Wheel cradle 112 and the axle cradle 115 are mounted to a plate type adjustable mounting base 120 that will allow longitudinal and transverse adjustment for varying wheel bases, and to allow shifting of the vehicle center-of-gravity to trim the boat for an even keel. Fixed rails 120*a* are attached to the vehicle deck to fasten the drive assembly to the boat. There is an intermediate bracket 121 between the platform or mounting base 120 and the fixed rails 120*a* to facilitate attachment and to allow longitudinal alignment of the drive assembly for varying distance between wheels (FIG. 15). Also, drum 110 can slide along shaft 114 to permit the adjustment of transverse wheel spacing, and then be locked in position.

The stern mounted propeller housings 133*a*, 133*b* can be released from their drive position and rotated about a hinged joint to any angular position, preferably 180° for road travel, but also to service when waterborne (as shown in dashed lines in FIG. 8). This feature is accomplished by the use of flexible hydraulic hoses to transmit power to the propellers 138.

Figure 16:
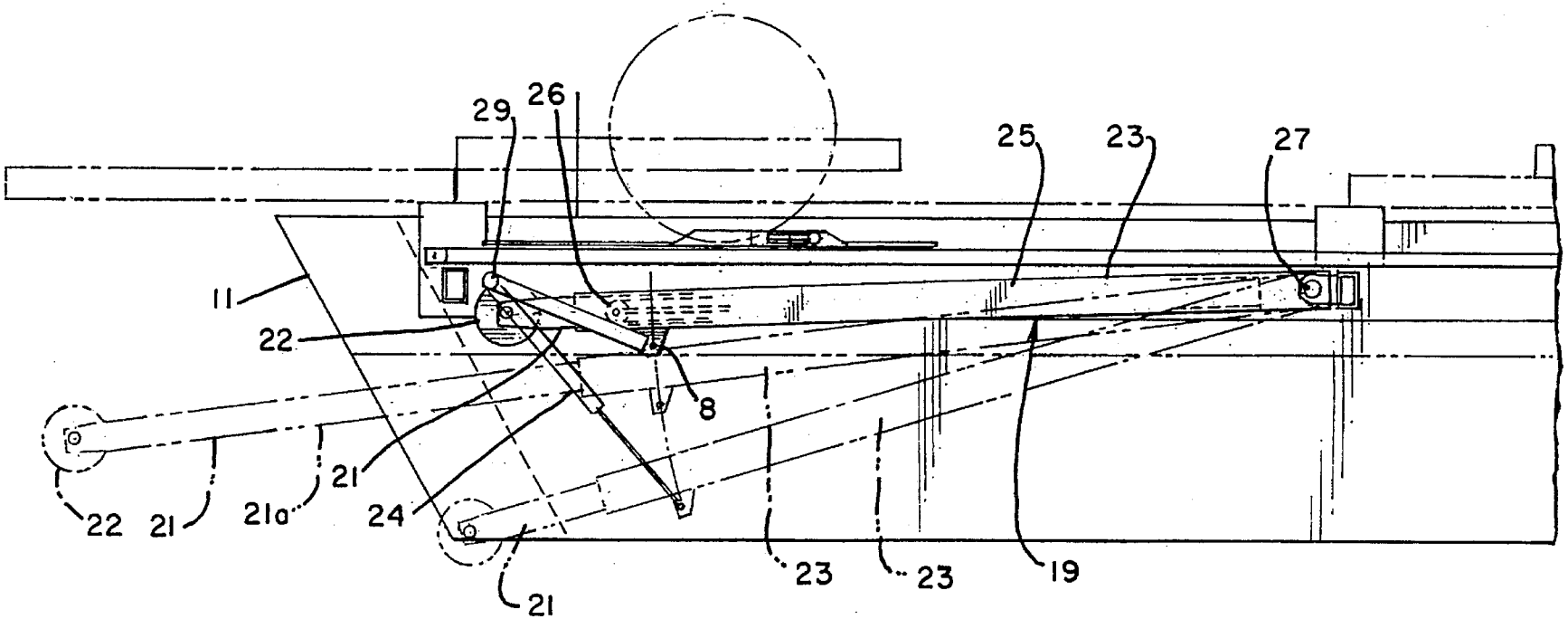
FIG. 16 is an enlarged, longitudinal sectional view of the bow of the boat, showing the bow support boom stabilizer mechanism.

The purpose of the stabilizers 19 (FIGS. 8 and 16) are to ground (fix) the bow of the boat to the shore (launch ramp) and provide a stable platform for the transfer of the land vehicle to the boat or shore. FIG. 16 shows various alternative positions for the stabilizer 19. The stabilizers provide the control to obtain an even keel during vehicle boarding and unboarding as the boat sinks or rises. Otherwise the boat will excessively tilt fore and aft as the vehicle load travels longitudinally over the boat. The stabilizers 19 are also able to compensate for the variable slope of the boat ramps, to allow the boat to approach the shore close enough to effect successful vehicle boarding.

This is accomplished by hydraulically extending the stabilizer telescoping booms 21 and contacting the ramp or beach with the boom wheel 22 while the boat is in deeper water, and then hydraulically lowering boom 21 to raise the bow while driving the boat closer to the shore, with the boom wheel 22 rolling on the ramp or beach. This bow-up attitude of the boat allows for the closest approach to the shore.

With the stabilizers deployed in the extended and supporting position, and with the boat in its shallowest draft position, loading of the land vehicle is accomplished, and the bow of the boat will not ground on the ramp. After the vehicle is fully loaded and engaged with the drive system, the boat can be driven off of the ramp with the stabilizer wheel supporting the bow load, and rolling with minimal resistance off of the ramp, thus effecting complete launch.

When the boat is configured for land trailing, the boom 21 is positioned with the boom wheels 22 protruding partially in front of and below the bow and bottom. This arrangement will prevent damage to the pontoons when unlevel road conditions are encountered, causing the bow to tilt downward and scrape against the road surface.

During water transport, when not in use, the stabilizers are retracted to their fully collapsed position and raised to their full height and stored directly under the vehicle deck.

The telescoping boom comprises two tubular sections. An outer section 23 is connected with a pivotal joint 27 attached to the pontoon approximately mid ship, with the other end attached to the piston rod end of a hydraulic cylinder 24 actuator with a pivotal joint 29, which is attached to the pontoon. This provides for the raising and lowering of the stabilizers 21, 23. The extendible inner tube 21*a* of boom 21, with the wheel 22 fixed to the free end of the boom, travels longitudinally within the outer tube by means of a cable 25 and pulley 26 system within tube 23, and controlled from the pivotal end of the boom. Booms 21 may thus be mechanically extended and retracted. Two of such booms 21 may be provided for stability, one on each side of the boat.

Remote control of the pump and cylinder system 24 may be provided, to permit controlling of the positions of stabilizers 19 from the driver's seat.

Thus, a versatile, vehicle-carrying boat is provided, which can be converted into a convenient trailer form.

The above has been offered for illustrative purposes only, and is not intended to limit the scope of the invention of this application, which is as defined in the claims below.

That which is claimed is:

1. A boat which comprises at least one floatable hull and a deck, said deck carrying a pair of power drive rollers for substantially lateral engagement with a pair of drive wheels carried on a powered axle of a vehicle carried on said boat, said power drive roller being operatively connected to a hydraulic drive system, said hydraulic drive system being operatively connected to a boat propeller, whereby power from the vehicle drive wheels can be transferred to said boat propeller, and a support, other than said power drive roller, for carrying a portion but less than all of the weight of the vehicle which normally passes through said drive wheel, in which said support comprises a cradle for supporting the vehicle powered axle, said cradle being pivotable between an operative position and a flattened position to permit said axle to pass horizontally over it.

2. The boat of claim 1 in which an arcing jack is present to raise and horizontally move said vehicle and the powered axle into engagement with said cradle.

3. The boat of claim 1 in which said deck carries a pair of horizontally pivotal steering platforms for respectively receiving the front wheels of a vehicle carried on said boat, said pivotal platforms being operatively connected to a hydraulic power transmission system, said hydraulic power system being operatively connected to a boat steering system, whereby the turning of vehicle front wheels mounted on said platforms causes corresponding turning of the boat steering system.

4. The boat of claim 3 in which said hydraulic drive system comprises hydraulic flow lines providing a hydraulic flow circuit through a pump and a hydraulic motor which is powered by pressurized fluid flowing in said circuit, said pump comprising an external-tooth gear pump capable of pumping fluid in said flow circuit in alternating, bidirectional flow, said motor having a drive shaft that rotates in either direction depending on the direction of said bidirectional flow, said hydraulic flow circuit also comprising a hydraulic fluid reservoir and a connected make-up pump to meter hydraulic fluid into said circuit, said pump and reservoir being small enough where the reservoir can hold no more than ¼ of the total hydraulic fluid in the system.

5. The boat of claim 1 in which said power drive roller is positioned in a horizontally spaced relation to the location of the axle of a vehicle drive wheel positioned in engagement with said power drive roller.

6. The boat of claim 1 in which each power drive roller for engaging a separate vehicle drive wheel is in operative connection with a separate hydraulic drive system which is operatively connected to a separate boat propeller.

7. A boat which comprises a pair of floatable hulls, a deck, and cross beams supported by the hulls and supporting said deck, said deck and cross beams having longitudinally extending pivot lines to permit said boat to assume a position of use comprising a flat deck and straight cross beams, and a laterally collapsed position having a folded deck and cross beams, said boat carrying an expansible and contractible tow bar for a boat/trailer, which comprises, a pair of telescoping bar members comprising at least two sections each, said bar members each being horizontally attached by first pivots to the same end of said boat/trailer, said bar members having outer ends that are horizontally pivotally attached to each other by a second pivot, at least one of said first pivots being horizontally slidable to vary the width of said tow bar.

8. The boat of claim 7 in which each of said hulls defines a watertight, open bottom wheel well, each wheel well carrying a hydraulically raisable and lowerable bogie wheel assembly, and a latch to hold said wheels in desired position.

9. The boat of claim 8 in which said deck carries a pair of horizontally pivotal steering platforms for respective receiving the front wheels of a vehicle carried on said boat, said pivotal platforms being operatively connected to a hydraulic power system, said hydraulic power system being operatively connected to a boat steering system, said hydraulic power system being exclusively powered by turning of the vehicle front wheels in said platforms, whereby the turning of vehicle front wheels mounted on said platforms causes corresponding turning of the boat steering system.

10. The boat of claim 9 in which said deck carries a pair of horizontally pivotal steering platforms for respective receiving the front wheels of a vehicle carried on said boat, said pivotal platforms being operatively connected to a hydraulic power system, said hydraulic power system being operatively connected to a boat steering system, said hydraulic power system being exclusively powered by turning of the vehicle front wheels in said platforms, whereby the turning of vehicle front wheels mounted on said platforms causes corresponding turning of the boat steering system.

11. A hydraulic power transmission system for a boat which comprises hydraulic flow lines providing a hydraulic flow circuit through a pump and a motor which is powered by pressurized fluid flowing in said circuit, said pump comprising an external-tooth gear pump capable of pumping fluid in said flow circuit in alternating, bidirectional flow, said motor having a drive shaft that rotates in either direction depending on the direction of said bidirectional flow, said hydraulic flow circuit also comprising a hydraulic fluid reservoir and a connected make-up pump to meter hydraulic fluid into said circuit.

12. The system of claim 11 in which said pump and reservoir is small enough where the reservoir can hold no more than ¼ of the total hydraulic fluid in the system.

13. A boat which comprises at least one floatable hull and a deck, said deck carrying at least one power drive roller for substantially lateral engagement with a drive wheel of a vehicle carried on said boat, said power drive roller being operatively connected to a hydraulic drive system, said hydraulic drive system being operatively connected to a boat propeller, whereby power from the vehicle drive wheel can be transferred to said boat propeller, and a support, other than said power drive roller, for carrying a portion but less than all of the weight of the vehicle which normally passes through said drive wheel, said support comprising a cradle for supporting a vehicle powered axle, said cradle being pivotable between an operative position and a flattened position to permit said axle to pass horizontally over it, and in which an arcing jack is present to raise and horizontally move said vehicle and the powered axle into engagement with said cradle.

14. The boat of claim 13 in which said deck carries a pair of horizontally pivotal steering platforms for respectively receiving the front wheels of a vehicle carried on said boat, said pivotal platforms being operatively connected to a hydraulic power transmission system, said hydraulic power transmission system being operatively connected to a boat steering system, whereby the turning of vehicle front wheels mounted on said platforms causes corresponding turning of the boat steering system.

15. The boat of claim 14 in which said hydraulic power system comprises hydraulic flow lines providing a hydraulic flow circuit through a pump and a hydraulic motor which is powered by pressurized fluid flowing in said circuit, said pump comprising an external-tooth gear pump capable of pumping fluid in said flow circuit in alternating, bidirectional flow, said motor having a drive shaft that rotates in either direction depending on the direction of said bidirectional flow, said hydraulic flow circuit also comprising a hydraulic fluid reservoir and a connected make-up pump to meter hydraulic fluid into said circuit, said pump and reservoir being small enough where the reservoir can hold no more than ¼ of the total hydraulic fluid in the system.

16. The boat of claim 15 in which said power drive roller is positioned in a horizontally spaced relation to the location of the axle of a vehicle drive wheel positioned in engagement with said power drive roller.

17. The boat of claim 16 in which each power drive roller for engaging a separate vehicle drive wheel is in operative connection with a separate hydraulic drive system which is operatively connected to a separate boat propeller.

18. The boat of claim 13 in which each power drive roller for engaging a separate vehicle drive wheel is in operative connection with a separate hydraulic drive system which is operatively connected to a separate boat propeller.

19. The boat of claim 13 in which said power drive roller is positioned in a horizontally spaced relation to the location of the axle of a vehicle drive wheel positioned in engagement with said power drive roller.

* * * * *